US005275491A

United States Patent [19]

Kuge et al.

[11] Patent Number: 5,275,491

[45] Date of Patent: Jan. 4, 1994

[54] ZIPPERED BAGS AND METHOD OF FORMING THE SAME

[75] Inventors: Raizo Kuge, Hannou; Yoshiji Moteki, Saitama, both of Japan

[73] Assignee: Kabushiki Kaisha Hosokawa Yoko, Japan

[21] Appl. No.: 924,855

[22] Filed: Aug. 4, 1992

[30] Foreign Application Priority Data

| | | | |
|---|---|---|---|
| Jan. 10, 1992 | [JP] | Japan | 4-021994 |
| Mar. 24, 1992 | [JP] | Japan | 4-096089 |
| Mar. 24, 1992 | [JP] | Japan | 4-096090 |

[51] Int. Cl.[5] ..... B65D 33/24

[52] U.S. Cl. ..... 383/61; 383/63; 383/64; 383/120

[58] Field of Search ..... 383/61, 63, 95, 120, 383/210, 93, 94, 211

[56] References Cited

U.S. PATENT DOCUMENTS

| | | | |
|---|---|---|---|
| 2,457,422 | 12/1948 | Warner | 383/95 X |
| 3,275,053 | 9/1966 | Kabana | 383/95 X |
| 4,655,862 | 4/1987 | Christoff et al. | 383/63 X |
| 4,705,174 | 11/1987 | Goglio | 383/210 |
| 4,736,450 | 4/1988 | Van Erden et al. | 383/120 X |
| 4,759,642 | 7/1988 | Van Erden et al. | 383/63 |
| 4,844,759 | 7/1989 | Boeckmann | 383/63 |
| 4,909,017 | 3/1990 | McMahon et al. | 383/63 X |
| 4,913,561 | 4/1990 | Beer | 383/120 X |
| 5,035,517 | 7/1991 | Edelman | 383/61 |
| 5,048,692 | 9/1991 | Handler et al. | 383/61 X |

FOREIGN PATENT DOCUMENTS

| | | | |
|---|---|---|---|
| 3-289451 | 12/1991 | Japan | 383/61 |
| 0453872 | 6/1968 | Switzerland | 383/93 |
| 2210018 | 6/1989 | United Kingdom | 383/61 |

*Primary Examiner*—Allan N. Shoap
*Assistant Examiner*—Jes F. Pascua
*Attorney, Agent, or Firm*—Ladas & Parry

[57] ABSTRACT

A bag such as gusset bag or flat bag comprises a tubular bag body having a pair of opposing flat portions constituting front and back side portions of the bag body and side portions, a zipper element mounted on inner surfaces of the exposed inner surface portions of the flat portions and the side portions, and a fused seal portion formed at an end opening portion of the bag body. The exposed inner surface portions are formed by folding outwardly portions of the flat portions and the side portions near the end opening of the bag body, for example, by cutting the bag body along the lines connecting the flat portions and the side portions of the bag body and bending the cut open portions outwardly along the predetermined base line. On the exposed inner surfaces, are mounted male and female members constituting the zipper element when mated, and after the mounting of the zipper element, the end opening is closed by engaging the male member with the female member as the zipper element and the end opening is fused to seal the end opening of the bag body and portions of the front and back portions near the cuts.

4 Claims, 17 Drawing Sheets

ZIPPERED BAGS AND METHOD OF FORMING THE SAME

BACKGROUND OF THE INVENTION

This invention relates to zippered bags, and more particularly, gusset bags and flat bags each provided with a zipper element for opening or closing an end opening of the bag through which a content filling in the bag can be easily taken out, and also is concerned with methods of forming such zippered bags.

In the known art, there has been provided a flat bag container having opposing flat portions, and four side peripheries of such bag are heat sealed (four side seal bag), and an opening of the bag through which an inner content can be taken out is closed or opened by providing a zipper element. With such a flat bag, it is possible to manufacture the bag by making coincident the delivery direction of a film material forming a flat bag container with a supply direction of the zipper element, thus being advantageous in a productivity.

Further, recently, it is attempted to apply the zipper element to a bag other than the four side seal bag, and in such attempt, a cap shaped bag member provided with a zipper element is preliminarily prepared and the cap shaped bag member is then applied to a bag body prepared separately from the cap shaped bag member. For example, a gusset bag provided with gores at both side portions of the bag body has a good self supporting property and a relatively large inner capacity, and accordingly, the usage thereof is widened and the application of the zipper element to the gusset bag has been desired.

However, since the gusset bag has a folded portion as gusset, there provided problems of difficult attachment of the zipper element.

Regarding bags other than the four side seal bag mentioned above, there is provided a bag which is generally formed of one sheet material and hence has a bonded edge like portion. Such prior art bag is shown in FIG. 29, as one example, in which, particularly, a central, i.e. back, bonded portion 952 is formed as a stepped portion providing no smooth surface portion. For this reason, it is difficult to surely apply such bag a cap shaped bag member, which is formed separately, provided with the zipper portion 965.

SUMMARY OF THE INVENTION

An object of this invention is to substantially eliminate defects or disadvantages encountered in the prior art and to provide gusset bags and flat bags provided with zipper elements which are easily attached to the bags and also provide methods of forming these bags provided with zipper elements.

This and other objects according to this invention can be achieved by providing, in one aspect, a gusset bag having one end to be formed as a bottom end and another end to be formed as an end opening through which a content packed in the gusset bag is taken out, the gusset bag comprising:

a bag body having tubular structure and composed of a pair of opposing flat portions constituting front and back side portions of the bag body and two side portions connecting front and back side portions at both side ends thereof and respectively having lines folded inward which extend along longitudinal directions of the side portions and along which the side portions are folded inward;

a zipper element mounted on inner surfaces of the flat portions at portions near the end opening of the bag body; and a fused seal portion formed to and near the end opening portion of the bag body to substantially entirely seal the end opening portion, the fused seal portion including an end seal portion extending substantially along an entire length of the end opening and side seal portions extending from both ends of the end seal portion along the side ends of the flat portions of the bag body, the side seal portions each extending beyond the portions on which the zipper element is mounted, wherein a sealing process is carried out integrally with portions of the side portions near the end opening of the bag body, which are once inwardly folded along the folding lines and then drawn out and folded outward from the end opening of the bag body for once opening the end opening.

The gusset bag of the above structure is formed by the steps of:

preparing a bag body having a tubular structure and composed of a pair of opposing flat portions constituting front and back side portions of the bag body and two side portions connecting front and back side portions at both side ends thereof and respectively having lines folded inward which extend along longitudinal directions of the side portions and along which the side portions are folded inward;

drawing out and outwardly folding portions of the side portions near an end opening of the bag body, which are once inwardly folded along the folding lines, with base points for the outward folding being optionally determined on the folding lines, to thereby form arris lines inwardly projecting inside the bag body from four corner portions of the end opening of the bag body to the base points;

opening outwardly portions of the flat portions and the side portions of the bag body along a base line formed by connecting most outward points of the outwardly folded lines of the side portions of the bag body so as to expose inner surfaces of these portions outward;

preparing a zipper element composed of a male member and a female member to be engaged with the male member;

mounting the male and female members on the exposed inner surfaces of the bag body, respectively, at portions apart by equal distance from the end opening of the bag body;

closing the end opening by engaging the male member with the female member as the zipper element; and fusing the end opening of the bag body together with the outwardly folded side portions thereof to thereby seal an end opening portion of the bag body.

The preparing step may includes a cutting step for cutting the bag body from the end opening thereof along lines connecting the flat portions and the side portions of the bag body to form four cuts each having a predetermined length.

The method may further includes a step, after the fusing step, of cutting portions of the side portions projecting outward from the side ends of the bag body along the side ends thereof, said projecting portions being formed by folding the portions outward along the folding lines once folded inward.

In another aspect, there is provided a gusset bag having one end to be formed as a bottom end and another end to be formed as an end opening through which a content packed in the gusset bag is taken out, the gusset bag comprising:

a bag body having a tubular structure and composed of a pair of opposing flat portions constituting front and back side portions of the bag body and two side portions connecting front and back side portions at both side ends thereof and respectively having lines folded inward which extend along longitudinal directions of the side portions and along which the side portions are folded inward;

a zipper element mounted on inner surfaces of the flat portions at portions near the end opening of the bag body; and a fused seal portion formed to and near the end opening portion of the bag body to substantially entirely seal the end opening portion, the fused seal portion including an end seal portion extending substantially along an entire length of the end opening and side seal portions extending from both ends of the end seal portion along the side ends of the flat portions of the bag body, the fused seal portion being formed by sealing portions formed by once cutting and opening the bag body from two corner portions of the end opening along lines connecting either one of the front and back portions of the flat portions to the side portions of the bag body and wherein the zipper element is mounted on the inner surfaces of the flat portions of the bag body once opened at portions near the end opening other than a line connecting ends of the cuts.

The gusset bag of the above structure is formed by the steps of:

preparing a bag body having a tubular structure and composed of a pair of opposing flat portions constituting front and back side portions of the bag body and two side portions connecting front and back side portions at both side ends thereof and respectively having lines folded inward which extend along longitudinal directions of the side portions and along which the side portions are folded inward;

cutting the bag body from two corner portions of the end opening by predetermined lengths along lines connecting either one of the front and back portions of the flat portions to the side portions of the bag body to form surfaces to be opened outward of the flat portions and the side portions of the bag body;

bending outwardly the flat portions and the side portions of the bag body with respect to a base line connecting ends of two cuts so as to expose outward inner surfaces of these portions;

preparing a zipper element composed of a male member and a femal member to be engaged with the male member;

mounting the male and female members on the exposed inner surfaces of the bag body, respectively, at portions apart by equal distances from the base line connecting the cut ends;

closing the end opening by engaging the male member with the female member as the zipper element; and fusing the end opening of the bag body and portions of the bag body near the cuts.

In a further aspect of this invention, there is provided a flat bag having one end to be formed as a bottom end and another end to be formed as an end opening through which a content packed in the flat bag is taken out, the flat bag comprising:

a bag body having a tubular structure and composed of a pair of opposing flat portions constituting front and back side portions of the bag body which are defined by side folding lines connecting both front and back side portions, said bag body being formed of one sheet material by mating both ends thereof, said mated ends being formed as outwardly protruded edge portion;

a zipper element mounted on inner surfaces of the flat portions at portions near the end opening of the bag body; and a fused seal portion formed to and near the end opening portion of the bag body to substantially entirely seal the end opening portion, the fused seal portion including an end seal portion extending substantially along an entire length of the end opening and side seal portions extending from both ends of the end seal portion along the side ends of the flat portions of the bag body, the side seal portions each extending beyond the portions on which the zipper element is mounted, said fused seal portion being formed by once cutting the bag body from the end opening along the side folding lines by predetermined lengths and once opening the front and back portions of the bag body along a base line connecting ends of the cuts to expose inner surfaces of the front and back portions to mount the zipper element on the exposed portions.

The flat bag of the structure described above is formed by the steps of:

preparing a bag body having a tubular structure and composed of a pair of opposing flat portions constituting front and back side portions of the bag body which are defined by side folding lines connecting both front and back side portions, the bag body being formed of one sheet material by mating both ends thereof;

cutting the bag body from an end opening by predetermined lengths along the side folding lines to form portions of the front and back portions of the bag body to be opened;

bending the front and back portions along a base line connecting ends of the cuts to expose inner surfaces of the portions of the front and back portions of the bag body;

preparing a zipper element composed of a male member and a female member to be engaged with the male member;

mounting the male and female members on the exposed inner surfaces of the bag body, respectively, at portions apart by equal distances from the base line;

closing the end opening by engaging the male member with the female member as the zipper element; and fusing the end opening of the bag body and portions of the front and back portions near the cuts.

In the foregoing aspects of this invention, the zipper element extends throughout a whole horizontal length of the bag body and the zipper element comprises a male member to be attached to the exposed one inner surface of the bag body and a female member to be engaged with the male member and attached to the exposed another inner surface of the bag body, the male and female members being attached at portions apart by equal distances from the base line.

The characteristic features and natures of this invention will be made further clear by the following descriptions with reference to the accompanying drawings.

DESCRIPTION OF THE PREFERRED EMBODIMENTS

One embodiment of a gusset bag provided with a zipper element of this invention will be first described hereunder with reference to FIGS. 1 to 9.

Figure 8:
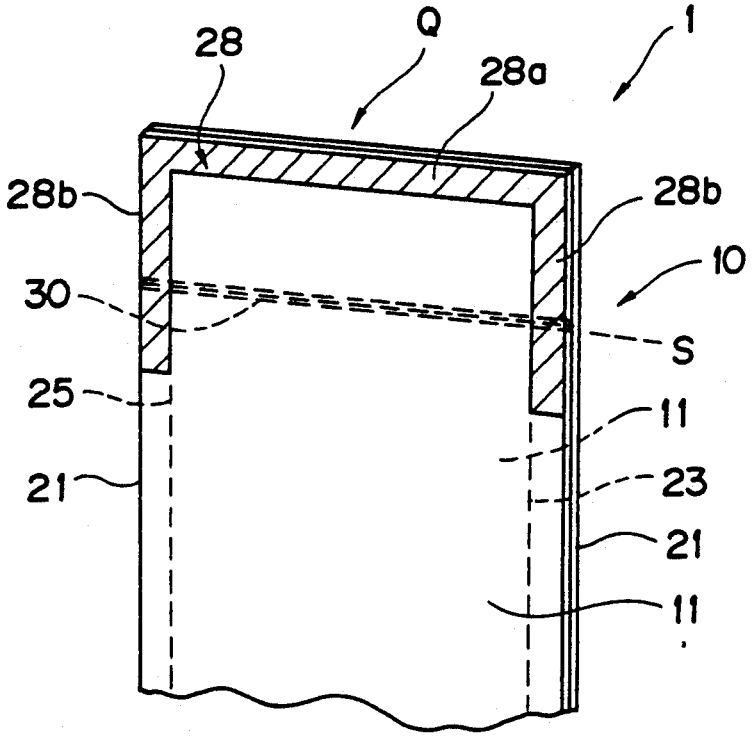
FIG. 8 is a perspective view of the gusset bag provided with the zipper element as a final product of the first embodiment.

First, referring to FIG. 8, a gusset bag 1 provided with a zipper element 30 has a bag body 10 composed of a pair of opposing flat portions forming front and back portions 11 and 11 of the bag 1 and two side portions 21 and 21 having folding lines 23 and 23 which extend vertically substantially along the central lines of the side portions and along which the side portions 21 and 21 are folded inwardly. The bag body 10 is usually formed of a plastic film, paper, aluminium foil or lamination member of these materials, but according to this embodiment, the material for the bag body and the thickness thereof have no specific limitation. The zipper element 30 is formed to the inner surfaces of the flat portions 11 and 11 at portions near an end opening, i.e. mouth portion Q of the bag body 10. The zipper element 30 is formed to freely open or close the opening Q of the bag body 10 and usually formed of general kind of plastic material.

The bag body 10 has a fused seal portion 28, shown with hatching lines in FIG. 8, which seals an upper end area 28*a* of the opening Q of the bag body 10 and side areas 28*b* and 28*b* extending from both the lateral ends of the upper end area 28*a* towards portions further inward a fixing portion S of the zipper element 30. That is, the side areas 28*b* and 28*b* extend downward, in the illustrated state, beyond the zipper element fixing line S. The sealing function of the seal portion 28 is performed by folding and drawing out the folding lines of two side portions outward from the opening end in a direction reverse to the original, i.e. inward, folding direction for once opening the end opening of the bag body 10. This function is integrally associated with a portion of a side tab 29 formed in a fold in state. This condition will be described hereinafter with reference to forming steps of the gusset bag.

Figure 9:
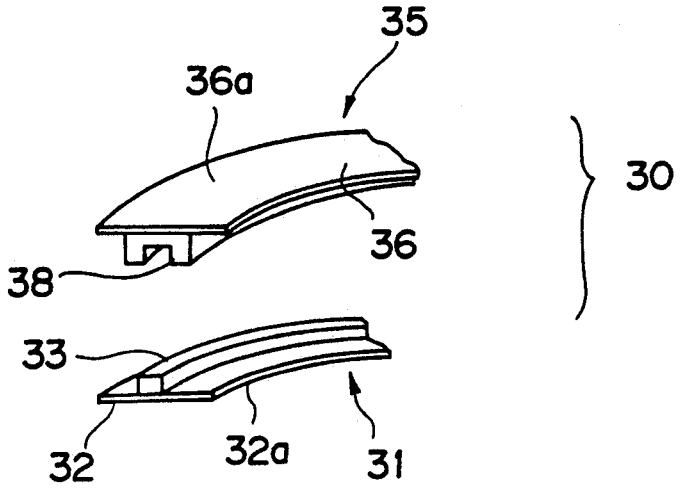
FIG. 9 is a developed perspective view of the zipper element to be applied to the gusset bag of the first embodiment.

The zipper element 30 has a belt shape structure, as shown in FIG. 9, in combination of a male member 31 and a female member 35 to be engaged with the male member 31. The male member 31 is composed of a flat base plate 32 and a belt like protruded portion 33 formed on one side of the base plate 32. The other side 32*a* of the base plate 32 has a flat surface capable of being bonded to the inner surface of one flat portion 11 of the bag body 10. The female member 35 is composed of a flat base plate 36 and a belt like member 38 having a recessed portion formed on one side of the base plate 36. The other side 36*a* of the base plate 36 has a flat surface capable of being bonded to the inner surface of the other flat portion 11 of the bag body 10. The sizes of the protruded portion of the male member 31 and the recessed portion of the female member 35 are designed to be tightly engaged with each other when mated.

The gusset bag 1 according to the first embodiment of this invention is formed by way of the following steps.

Figure 1:
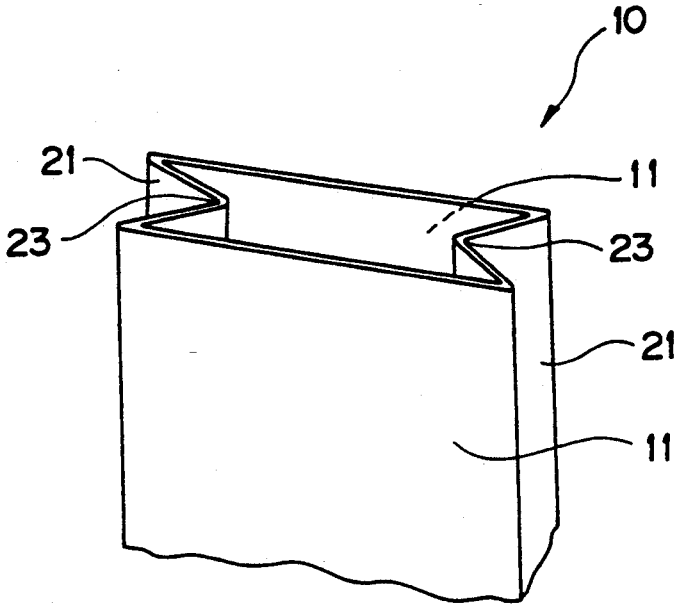
FIGS. 1 to 7 are perspective views of a gusset bag provided with a zipper element of a first embodiment of this invention in accordance with the forming steps thereof.

First, with reference to FIG. 1, there is prepared a cylindrical or tubular bag body 10 formed with a pair of flat portions 11 and 11 constituting front and back side portions of the bag body 10 and two side portions 21 and 21 having lines 23 and 23 to be folded inwardly, the lines extending vertically substantially along the central lines of the side portions 21 and 21.

Figure 2:
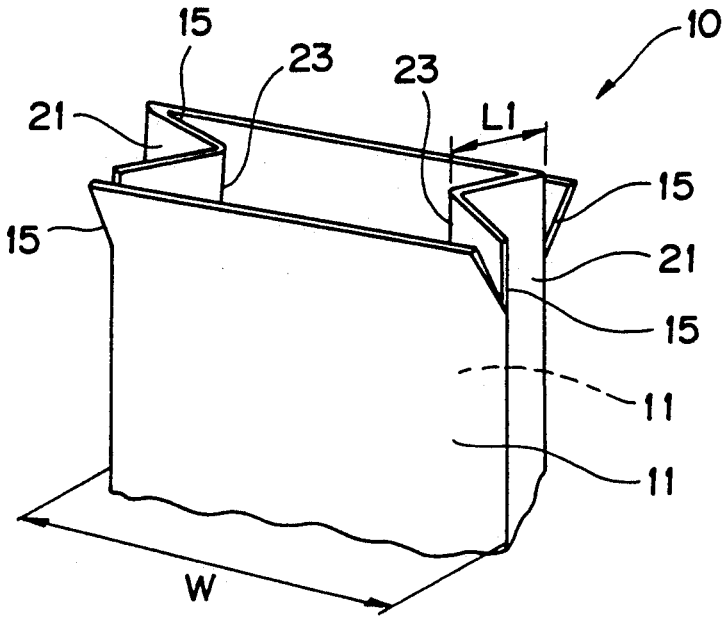

Next, as shown in FIG. 2, four cuts 15, 15, 15 and 15 are made along lines through which the side portions 21 and 21 are connected to the flat portions 11 and 11 at four corner portions of the bag body 10 so as to extend from the upper ends, as viewed, of the bag body to portions each apart from the upper end by a predetermined distance. These cuts 15 have substantially the same cut depth. These cuts 15 are formed to ensure a portion to which the zipper 30 can be surely attached and, in a case where, a width L1 of the side portion to be folded is relatively small with respect to a width W of the bag body 10, for example L1/W=0.10 to 0.13, the formation of such cuts is particularly effective.

Figure 3:
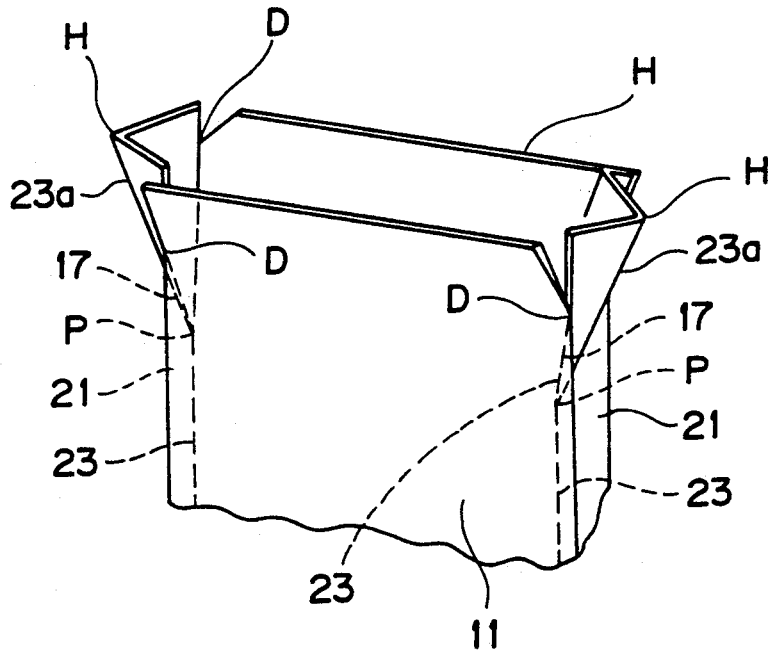
Figure 4:
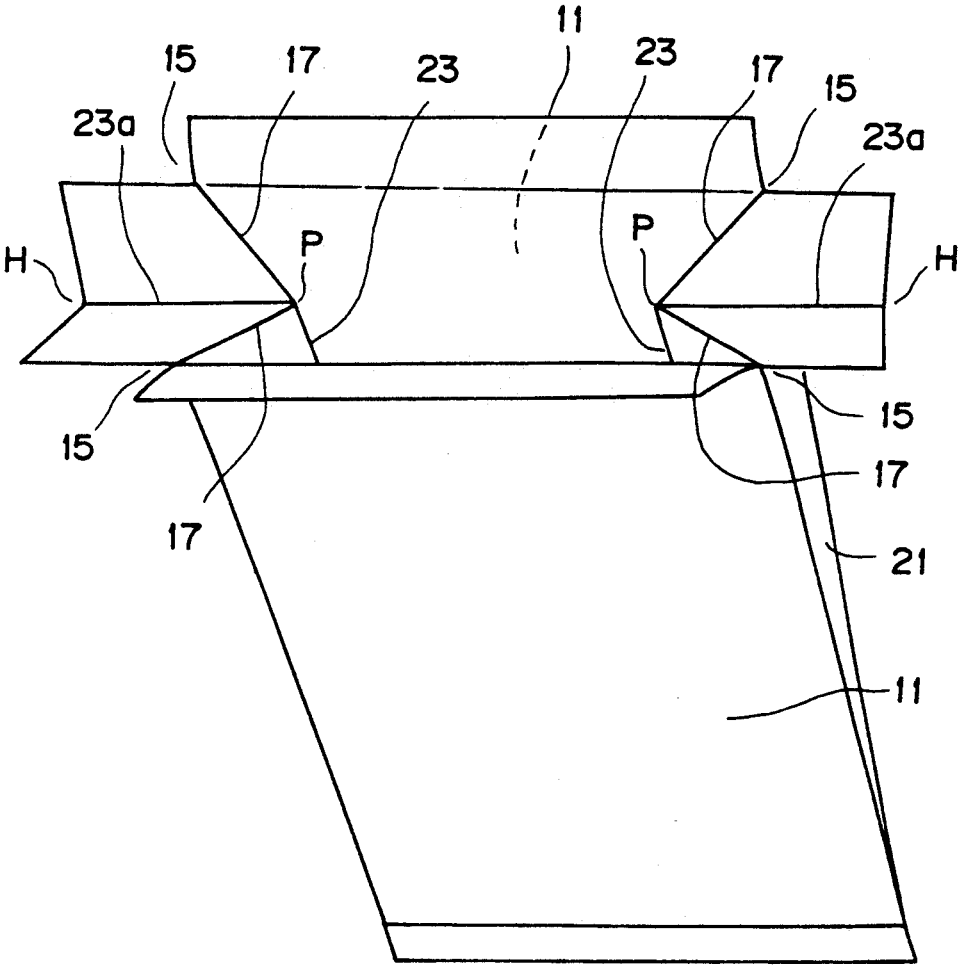

In the next step, as shown in FIGS. 3 and 4, the opening of the bag body 10 is opened by partially folding reversely, i.e. outwardly, the folding line 23 and 23 at optional points P and P being base points. Namely, portions of the folding lines 23 and 23 each having a length from the point P to a point H at the upper end of the bag body are reversely, i.e. outwardly, pulled out and folded as folding lines 23*a* and 23*a*. According to this reverse folding, lines connecting the four corner portions, in this example, four end portions D of four cuts 15, of the bag body 10 to the points P are necessarily formed as four arris lines 17, 17, 17 and 17 as shown in FIG. 3. The arris lines 17 project in the inward direction of the bag body 10, respectively.

Figure 5:
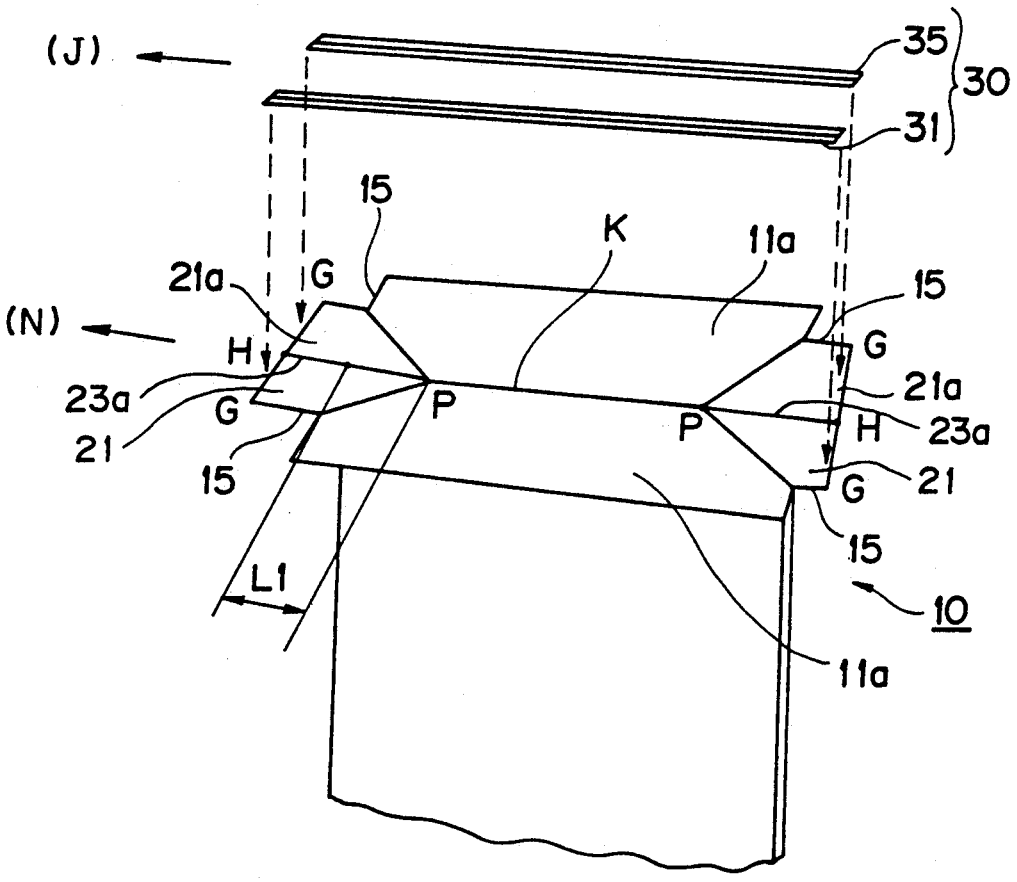

As shown in FIG. 5, in the next step, the upper portions of the flat portions 11 and the side portions 21 are together folded or bent outward with a base line K which connects the points H and H, i.e. upper ends of the outwardly folded lines 23*a*, thus forming four opened surfaces 11*a*, 11*a* and 21*a*, 21*a* as exposed inner side surfaces of the bag body 10. In this example, as the base points P are set so that length of the line GH shown in FIG. 5 is substantially equal to the width L1, the opened surfaces 11*a* and 21*a* constitute flat surfaces lying substantially the same plane. In this step, the bag body 10 is delivered in a direction N, and during this step, the belt like male member 31 and female member 35 forming the zipper element 30 are conveyed above the opened surfaces 11*a* and 21*a* along a direction J, thus the conveying directions N and J of the bag body 10 and the zipper element 30 accord with each other, whereby the working of the bag body can be easily made, and is suitable for a machine working.

Figure 6:
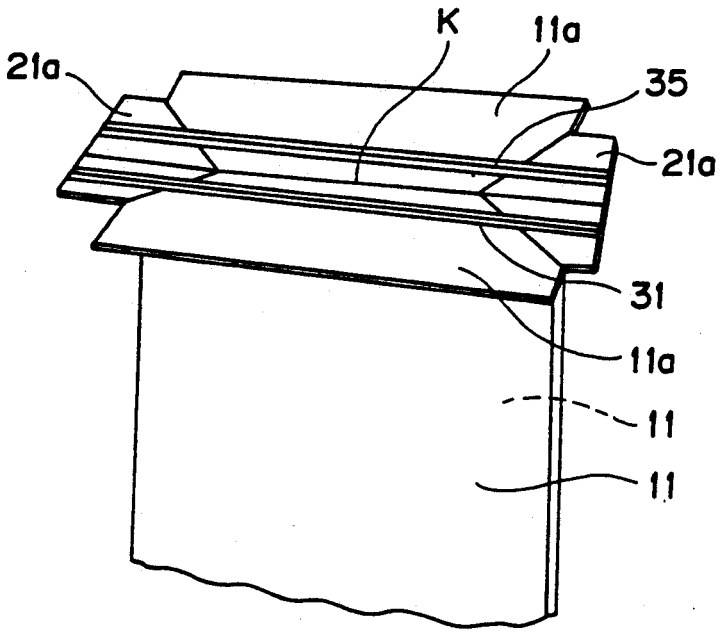

Further, in the next step, as shown in FIG. 6, the male member 31 and the female member 35 forming the zipper element 30 are fixed to the exposed opened surfaces 11*a* and 21*a* at portions apart from equal distances from the central line, i.e. line K, usually in parallel with each other. The fixing of the male and female members 31 and 35 is usually effected by a heat seal method.

Figure 7:
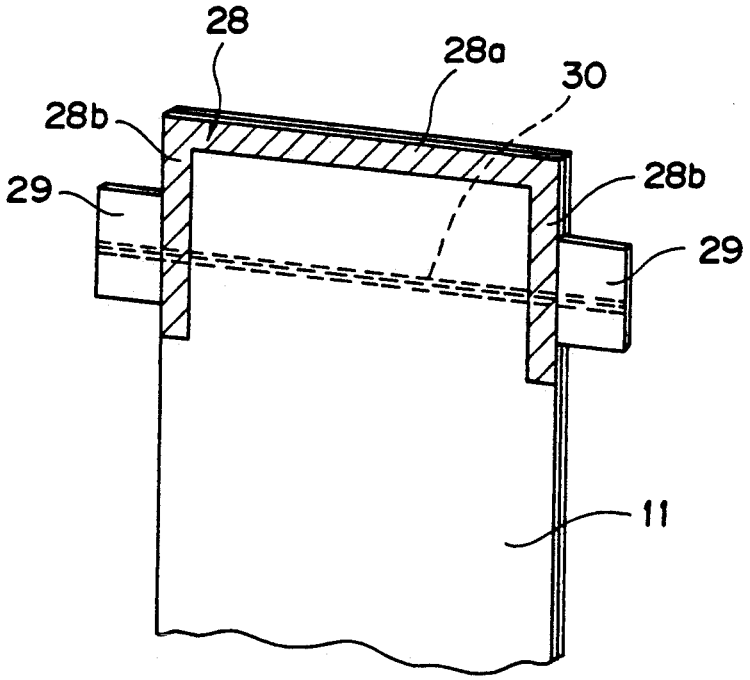

Then, as shown in FIG. 7, the opened surfaces 11*a* and 21*a* are closed so that the male and female members 31 and 35 are mated and engaged with each other so as to function as the zipper element 30. Thereafter, the upper end portion 28*a* forming the opening end of the bag body 10 and the side portions 28*b* and 28*b* are both fused at the upper sides of the bag body 10 to form a tight close seal portion. After this step, tubs 29 and 29 projecting from the sides of the bag body 10 are formed when the opened surfaces 11*a* and 21*a* are mated and are then cut out along the vertical side ends of the bag body 10, thus completing the gusset bag provided with the zipper element such as shown in FIG. 8.

A content to be contained in gusset bag thus formed is usually packed from the bottom side now being opened, and the bottom side is thereafter fused and sealed. On the contrary, it may be possible to provide the bag body having the bottom side initially sealed. In this case, the content is packed from the upper opening by opening the zipper element 30 and the zipper element 30 is then closed and the upper end portion 28*a* is finally sealed. In the present invention, it is possible to fix the zipper element 30 to the opened surface of the bag body with the male and female members 31 and 35 being engaged.

A gusset bag 2 provided with a zipper element will be described hereunder as a second embodiment of this invention in accordance with its forming with reference to FIGS. 10 to 16.

Figure 10:
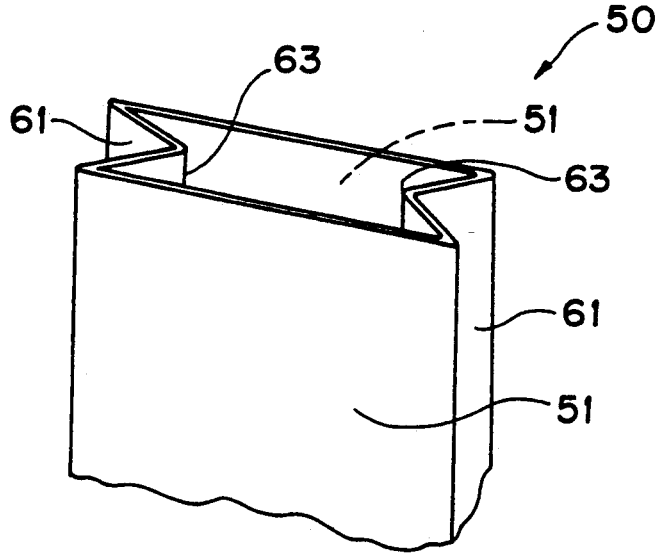
FIGS. 10 to 15 are perspective views similar to those of FIGS. 1 to 7 but showing a second embodiment of this invention.

First, as shown in FIG. 10, a cylindrical or tubular bag body 50 is prepared and the bag body 50 is composed of substantially the same structure as that of the first embodiment shown in FIG. 1. Namely, the bag body 50 is composed of a pair of opposing flat portions 51 and 51 constituting front and back portions of the bag body 50 and two side portions 61 and 61 each having an inwardly folded line 63 extending along substantially the central line of the side portion 61. The bag body 50 is formed of a material substantially the same as that of the first embodiment.

Figure 11:
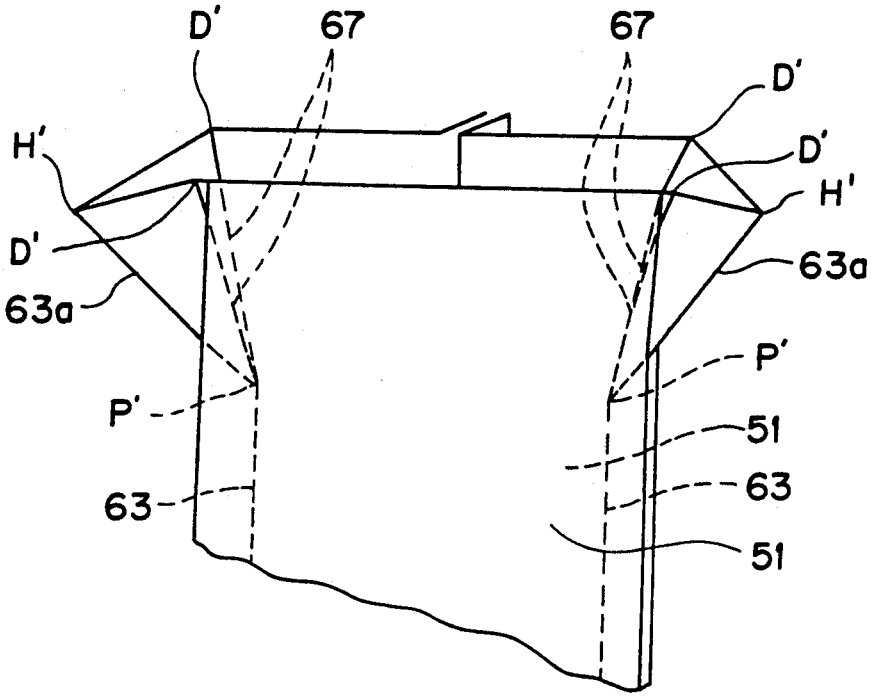
Figure 12:
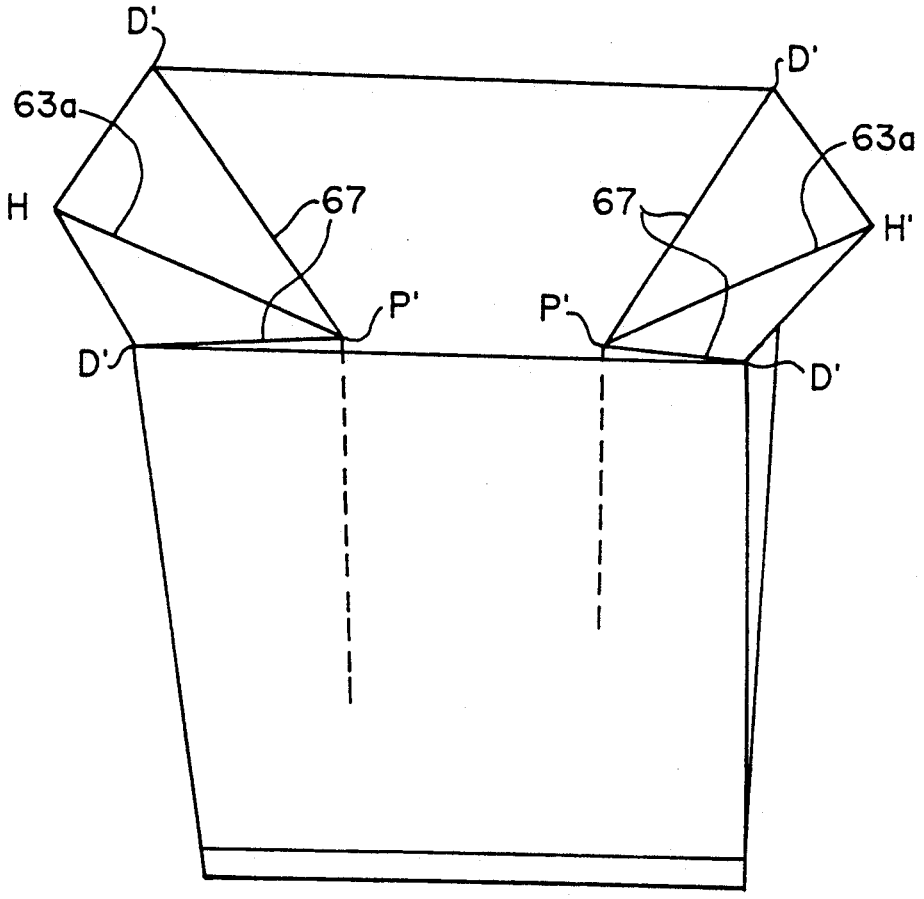

Next, as shown in FIG. 11, an opening of the bag body 50 is opened by partially pulling out and folding reversely, i.e. outwardly, the folding line 63 and 63 with optional points P' and P' being base points. Namely, portions of the folding lines 63 and 63 each having a length from the point P' to a point H' at the upper end of the bag body 50 are pulled out and reversely folded as folding lines 63*a* and 63*a*. According to this reverse folding lines connecting the four corner portions D' to the points P' are formed as four arris lines 67, which are inwardly projected inside the bag body 50 as shown in FIG. 11 or 12. In this second embodiment, since a gusset bag having a relatively large folding width (corresponding to a line connecting the points H' and D') is intended, the position of the points P' are determined, for example, to satisfy the relationship of the line $H'P' > H'D'$.

Figure 13:
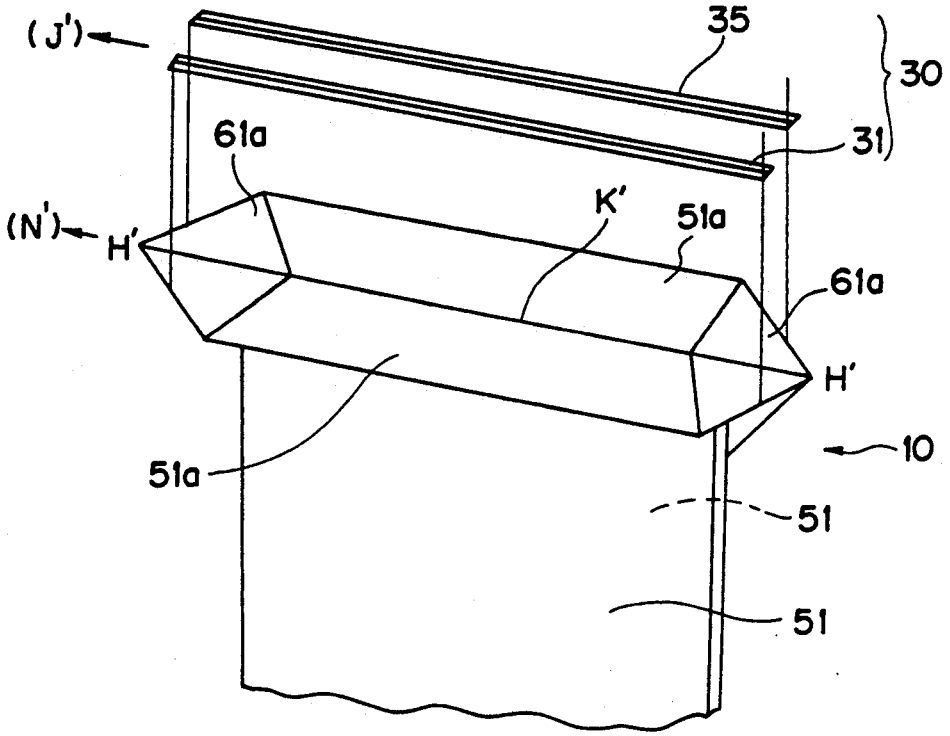

As shown in FIG. 13, in the next step, the upper portions of the flat portions 51 and the side portions 61 are together folded or bent outward with a base line K' which connects the points H' and H', i.e. upper ends of the outwardly folded lines 63*a*, being the base line, thus forming four opened surfaces 51*a*, 51*a* and 61*a*, 61*a* as exposed inner side surfaces of the bag body 50. In this step, the bag body 50 is delivered in a direction N', and during this step, the belt like male member 31 and female member 35 forming the zipper element 30 are conveyed above the opened surfaces 51*a* and 61*a* along a direction J', thus the conveying directions N' and J' of the bag body 50 and the zipper element 30 accord with each other, whereby the working of the bag body can be easily made, and is suitable for a machine working.

Figure 14:
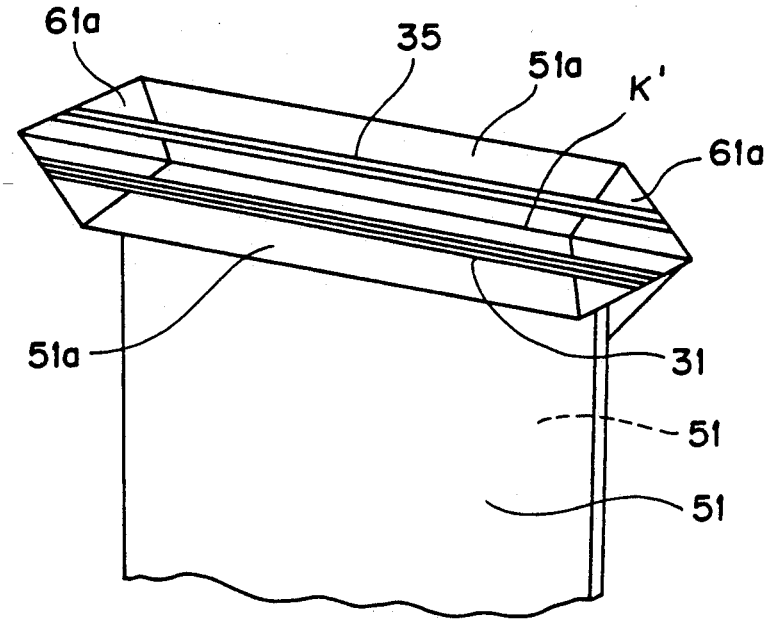

Further, in the next step, as shown in FIG. 14, the male member 31 and the female member 35 forming the zipper element 30 are fixed to the exposed opened surfaces 51*a* and 61*a* at portions apart from equal distances from the central line, i.e. line K', usually in parallel with each other. The fixing of the male and female members 31 and 35 is usually effected by a heat seal method.

Figure 15:
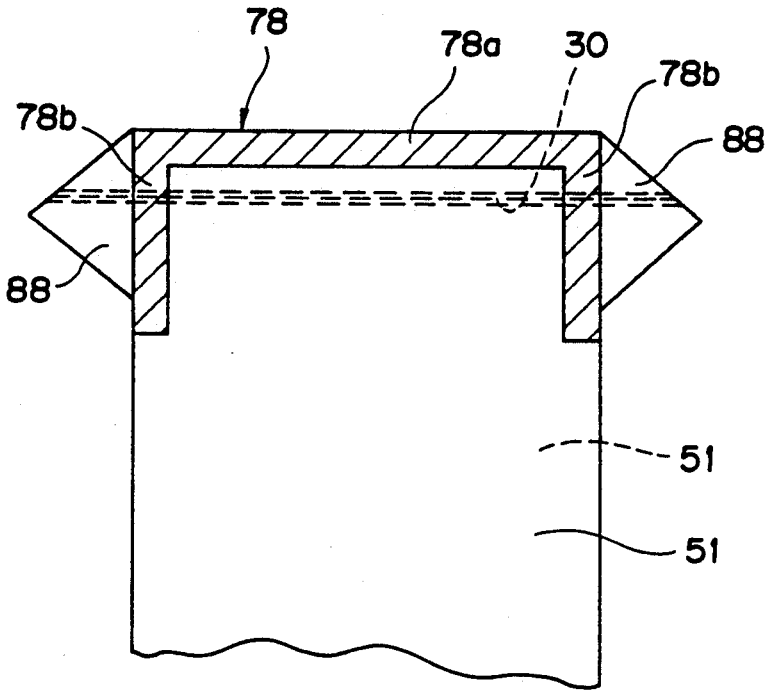
Figure 16:
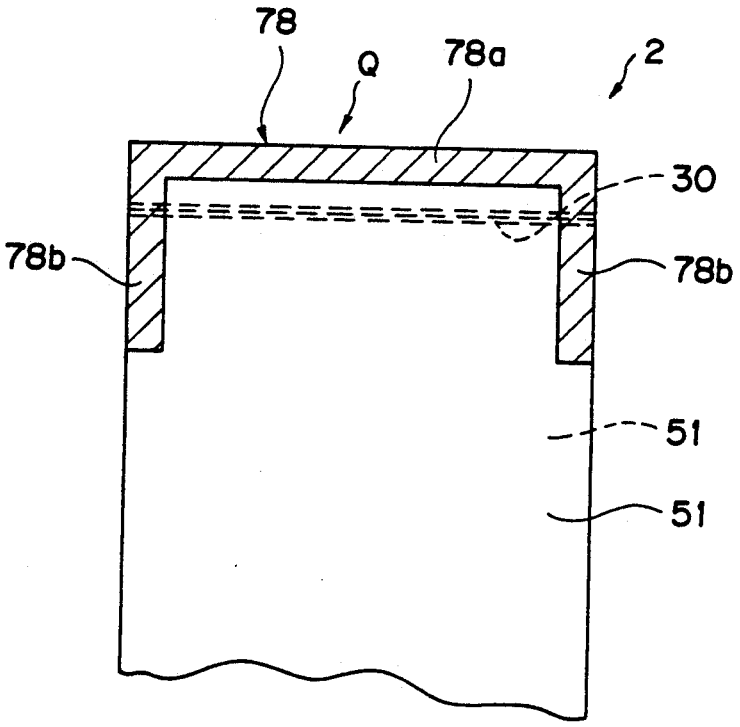
FIG. 16 is a perspective view of the gusset bag provided with the zipper element as a final product of the second embodiment.

Then, as shown in FIG. 15, the opened surfaces 51*a* and 61*a* are closed so that the male and female members 31 and 35 are mated and engaged with each other so as to function as the zipper element 30. Thereafter, a fused seal portion 78 is applied, and this portion is composed of the upper end portion 78*a* forming the opening end of the bag body 50 and the folded side portions 78*b* and 78*b* which are both fused at the upper sides thereof so that the fused seal portion 78 of the bag body 50 forms a tight close seal portion. After this step, substantially triangular tubs 88 and 88 projecting from the sides of the bag body 50 which are formed when the opened surfaces 51*a* and 61*a* are mated are cut out along the vertical side ends of the bag body 50, thus completing the gusset bag provided with the zipper element such as shown in FIG. 16.

A content to be contained in gusset bag thus formed is usually packed from the bottom side now being opened, and the bottom side is thereafter fused and sealed. On the contrary, it may be possible to provide the bag body having the bottom side initially sealed. In this case, the content is packed from the upper opening by opening the zipper element 30 and the zipper element 30 is then closed and the upper end portion 78*a* is finally sealed.

According to these first and second embodiments of this invention, the bag body is preliminarily formed by an ordinary manner. Then, the side portions of the upper opening portion of the bag body are folded or bent outwardly in directions reverse to those once being folded inwardly along the folding lines to thereby partially expose the inner surfaces of the flat portions and the side portions of the upper portion of the bag body. The male and female members constituting the zipper element are attached to the exposed surfaces so as to be engaged with each other when they are mated. According to this structure, the zipper element can be easily and securely attached to the bag body.

A third embodiment of a gusset bag provided with a zipper element according to this invention will be further described hereunder with reference to FIGS. 17 to 22.

Figure 21:
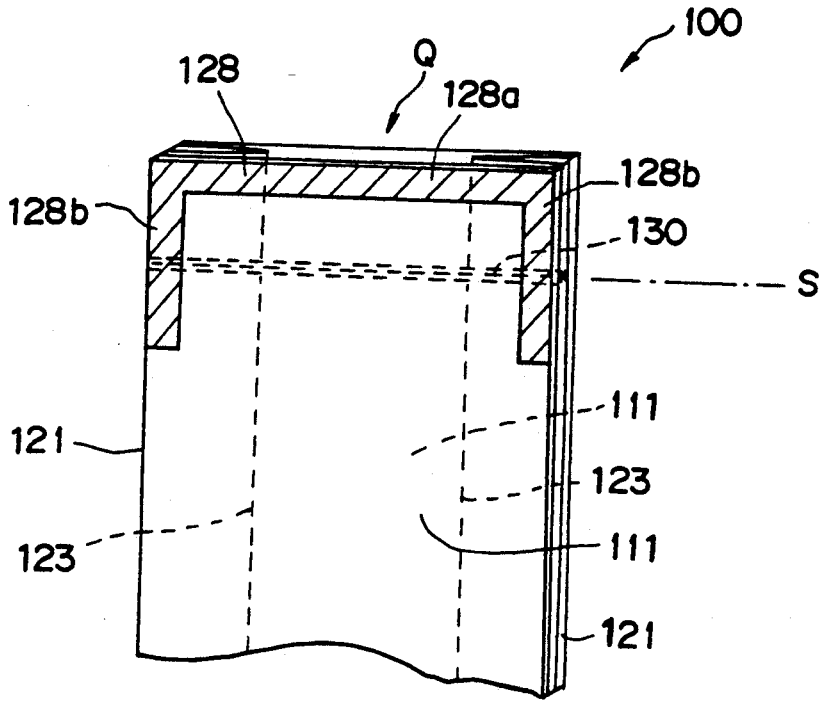
FIG. 21 is a perspective view of the gusset bag provided with the zipper element as a final product of the third embodiment.

First, referring to FIG. 21, a gusset bag 100 provided with a zipper element 130 has a bag body 110 composed of a pair of opposing flat portions forming front and back portions 111 and 113 of the bag and two side portions 121 and 121 having folding lines 123 and 123 which extend vertically substantially along the central lines of the side portions and along which the side portions 121 and 121 are folded inwardly. The bag body 110 is usually formed as a cylindrical or tubular body and made of a plastic film, paper, aluminum foil or lamination member of these materials, but according to this embodiment, the material for the bag body and the thickness thereof have no specific limitation. The zipper element 130, composed of male and female members, mentioned hereunder, is formed to the inner surfaces of the flat portions 111 and 113 at portions near an opening, i.e. mouth portion Q of the bag body 110. The zipper element 130 is formed to freely open or close the opening Q of the bag body 110 and usually formed of general kind of plastic material.

The bag body 110 has a fused seal portion 128, shown with hatching lines in FIG. 21, which seals an upper end area 128*a* of the opening Q of the bag body 110 and side areas 128*b* and 128*b* extending from both ends of the upper end area 128*a* towards portions further downward a fixing portion S of the zipper element 130. That is, the side areas 128*b* and 128*b* extend downward, in the illustrated state, beyond the zipper element fixing line S.

The zipper element 130 will be attached to an exposed inner surface portion of the bag body 110 which is formed by forming cuts from the upper end of the bag body along the connecting portions of one flat surface portion to the side portions by predetermined lengths and bending the one flat portion with the base line connecting the bottoms of the cuts. This condition will be described hereunder with reference to the forming steps of the gusset bag 100.

Figure 22:
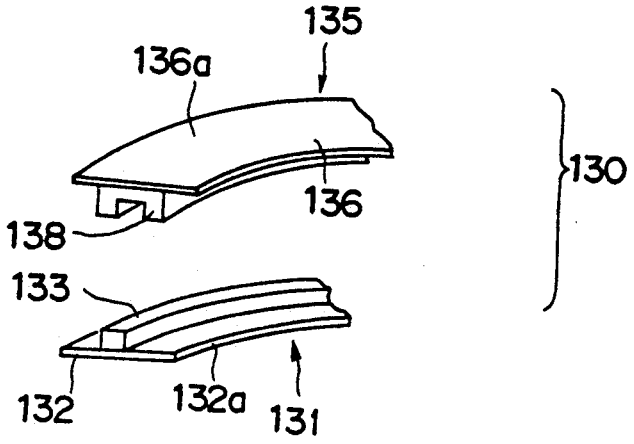
FIG. 22 is a developed perspective view of the zipper element to be applied to the gusset bag of the third embodiment.

The zipper element 130 has a belt shape structure as shown in FIG. 22, in combination of a male member 131 and a female member 135 to be engaged with the male member 131. The male member 131 is composed of a flat base plate 132 and a belt like protruded portion 133 formed on one side of the base plate 132. The other side 132*a* of the base plate 132 has a flat surface capable of being bonded to the inner surface of one flat portion 111 of the bag body 110. The female member 135 is composed of a flat base plate 136 and a belt like member 138 having a recessed portion formed on one side of the base plate 136. The other side 136*a* of the base plate 136 has a flat surface capable of being bonded to the inner surface of the other flat portion 111 of the bag body 110. The sizes of the protruded portion of the male member 131 and the recessed portion of the female member 135 are designed to be tightly engaged with each other when mated.

The gusset bag 100 according to the third embodiment of this invention is formed by way of the following steps.

Figure 17:
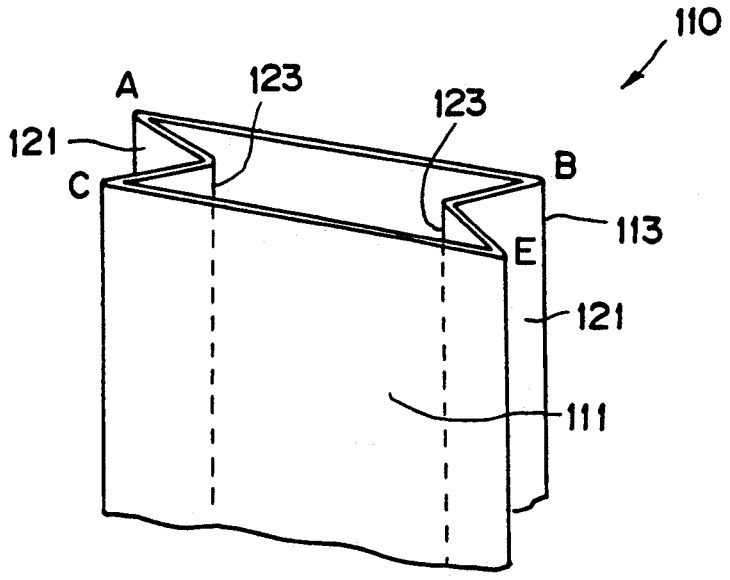
FIGS. 17 to 20 are perspective views similar to those of FIGS. 10 to 15 but showing a third embodiment of this invention.

First, with reference to FIG. 17, there is prepared a cylindrical or tubular bag body 110 composed of a pair of flat portions 111 and 113 constituting front and back side portions of the bag body 110 and two side portions 121 and 121 having lines 123 and 123 folded inwardly, the lines extending vertically substantially along the central lines of the side portions 121 and 121.

Figure 18:
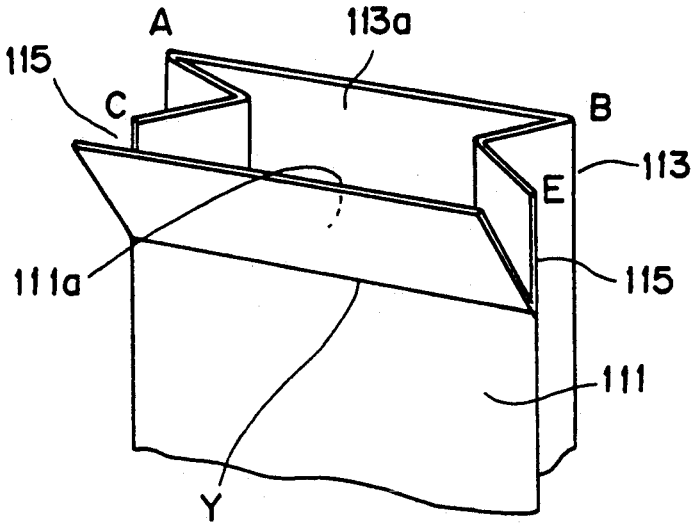

Next, as shown in FIG. 18, two cuts are made along lines connecting the side portions 121 and 121 to the flat portions 111 and 113 at two corner portions, for examples C and E of the four corners A, B, C and E, of the bag body 110 so as to extend from the upper ends, i.e. opening ends, of the bag body to portions each apart from the upper end by a predetermined distance. These cuts have substantially the same cut depth. These cuts are formed to ensure a portion to which the zipper element 130 can be surely attached.

Figure 19:
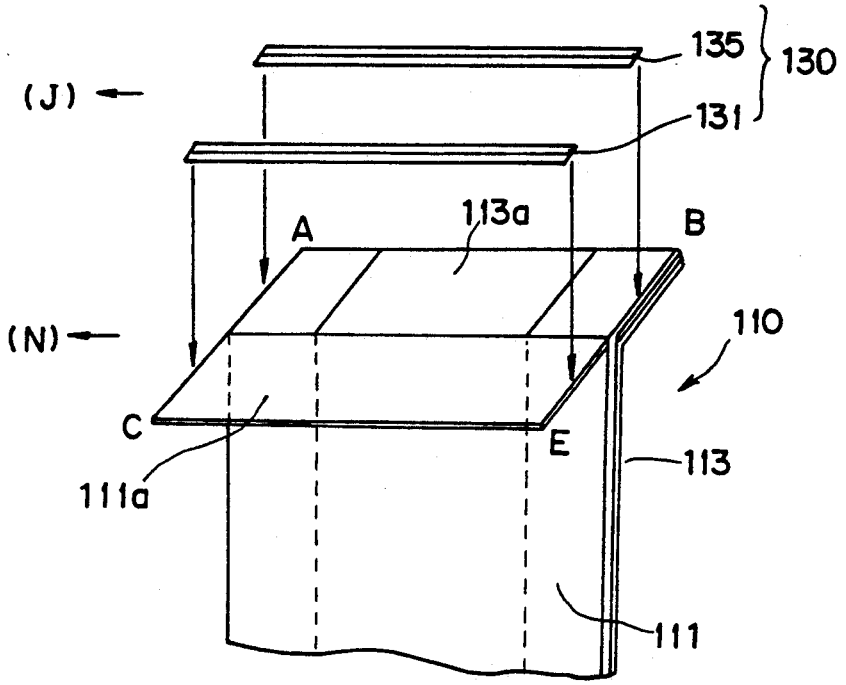

Then, as shown in FIG. 19, the flat portions 111 and 113 and the side portions 121 and 121 are bent outward along the base line Y connecting the bottom portions of the cuts to expose opened inner surfaces 111*a* and 113*a* of the flat portions, in which the exposed surface 111*a* is only a portion of one flat surface 111 and the exposed surface 113*a* includes a portion of the other flat surface 113 and the side portions 121 in this embodiment. In this step, the bag body 110 is delivered in a direction N, which accords with the delivered direction of the zipper element 130 above the exposed surfaces 111*a* and 113*a*, and thus the bag body is easily worked and the steps are suitable for machine working.

Figure 20:
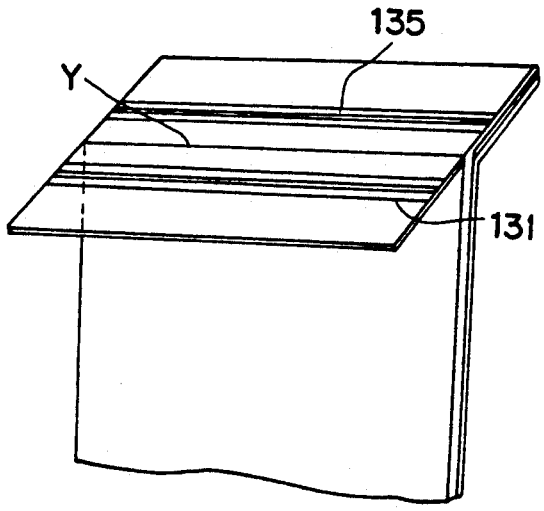

Further, in the next step, as shown in FIG. 20, the male member 131 and the female member 135 forming the zipper element 130 are fixed to the exposed opened surfaces 111*a* and 113*a*, respectively, at portions apart by equal distance from the base line Y usually in parallel with each other. The fixing of the male and female members 131 and 135 is usually effected by a heat seal method.

Then, as shown in FIG. 21, the opened surfaces 111*a* and 113*a* are closed so that the male and female members 131 and 135 are mated and engaged with each other so as to function as the zipper element 130. Thereafter, a fused seal portion 128 is applied, and the seal portion 128 is composed of an upper end portion 128*a* forming the opening end of the bag body 110 and the folded side portions 128*b* and 128*b* extending downward from the upper end portion 128*a*, near the upper ends of the cuts, both fused at the upper sides thereof so that the fused portion 128 of the bag body 110 forms a tight close seal portion (the sealing surface being shown with hatching lines in FIG. 21), thus completing the gusset bag provided with the zipper element 130.

A content to be contained in gusset bag thus formed is usually packed from the bottom side now being opened, and the bottom side is thereafter fused and sealed. On the contrary, it may be possible to provide the bag body having the bottom side initially sealed as disclosed with reference to the former first and second embodiments.

According to the third embodiment of this invention, the bag body is preliminarily formed by an ordinary manner. Then, the two cuts are made from two corner portions of the upper end of the flat portion of the bag body. The flat portions of the upper opening portion of the bag body are bent outwardly to thereby partially expose the inner surfaces of the flat portions. The male and female members constituting the zipper element are attached to the exposed surfaces, respectively. According to this structure, the zipper element can be easily and surely attached to the bag body.

Another embodiment of this invention will be described hereunder with reference to FIGS. 23 to 28, and this embodiment is concerned with a flat bag provided with a zipper element.

Figure 27:
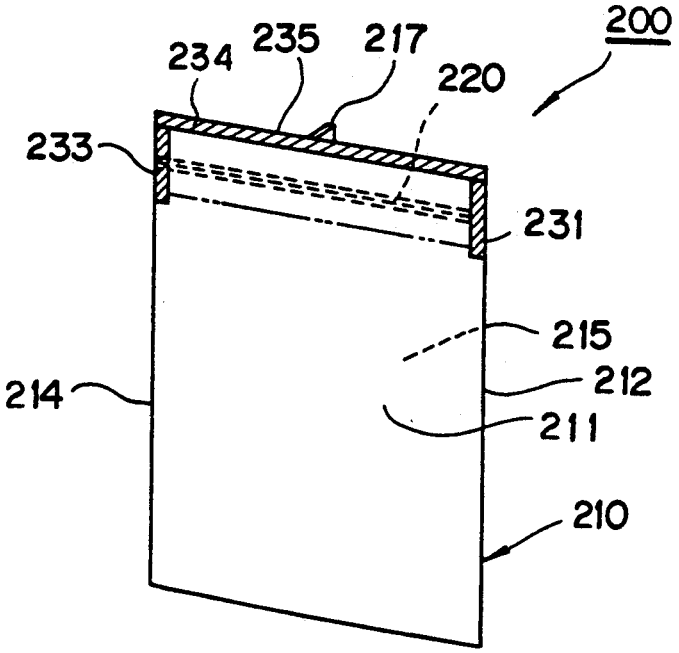
FIG. 27 is a perspective view of the flat bag provided with the zipper element as a final product of the fourth embodiment.

First, referring to FIG. 27, a tubular flat bag 200 provided with a zipper element 220 comprises a bag body 210 generally composed of a pair of flat portions 211 and 215 opposing to each other constituting front and back portions of the bag body 210. The zipper element 220 comprises male and female members, mentioned hereinafter, to be mated with each other which are attached to the inner surfaces of the flat portions at portions near an upper end, as viewed, of the bag body 210 constituting an opening thereof and adapted to freely open the opening. The zipper element 220 is usually formed of a plastic material. The tubular bag body 210 is basically formed of one sheet material by bonding together both end sides of the sheet before the attachment of the zipper element 220, and accordingly, the bonded end portion appears on the back surface of the bag body 210 as a protruded edge like portion 217 in FIG. 27. The front and back portions 211 and 215 of the bag body 210 are made continuous through folded lines 212 and 214 as side lines. A fused seal portion 235 is formed to the opening end portion of the bag body 210 so as to entirely seal the opening thereof. The bag body 210 may be formed of a plastic film, a paper, an aluminium foil or a lamination thereof, but it is not limited to such material and the thickness thereof may be optionally selected as occasion demands. The fused seal portion 235 includes an end seal portion 234 extending substantially along an entire length of the end opening, and side fused seal portions 231, 233 which extend downward from both lateral ends of the upper seal portion along the folded lines 212 and 214 to portions below the attachment of the zipper element 220. This is because, as mentioned hereinafter, the once opened opening end portion is sealed thereafter.

Figure 28:
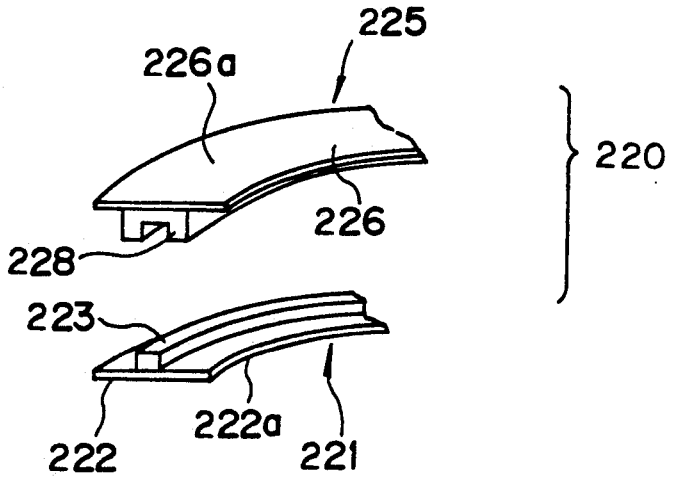
FIG. 28 is a developed perspective view of the zipper element to be applied to the flat bag of the fourth embodiment.
Figure 29:
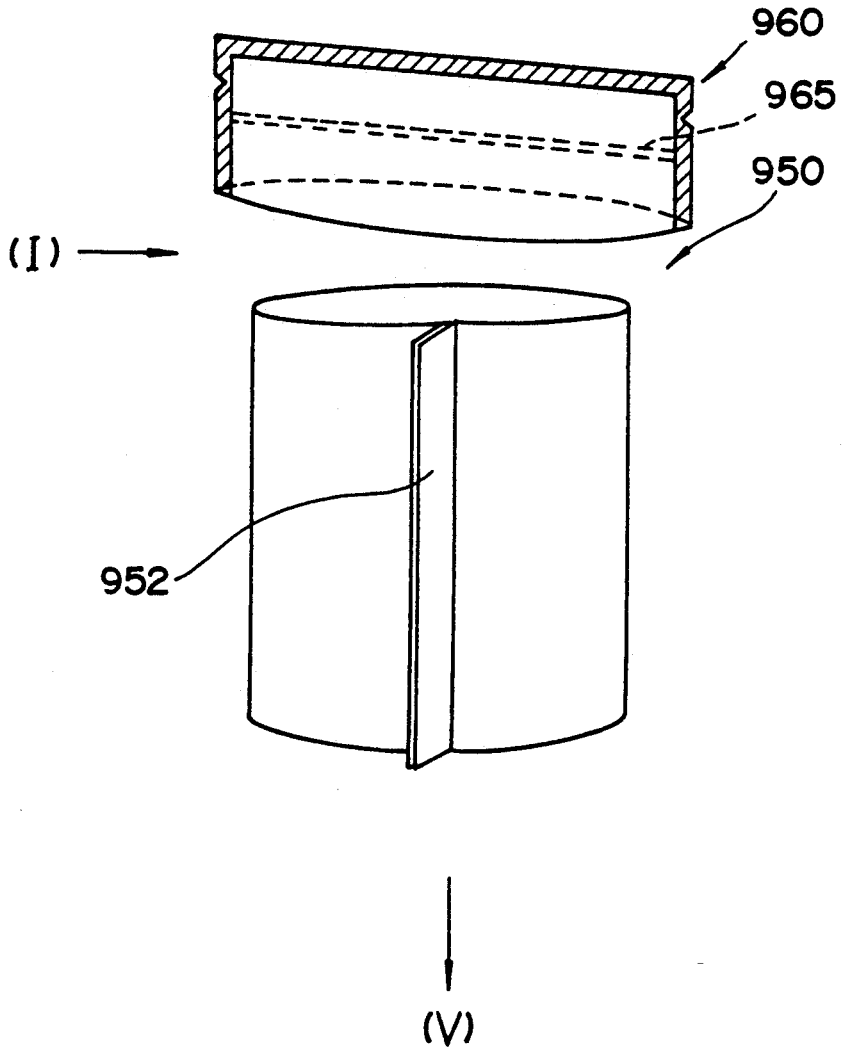
FIG. 29 PRIOR ART
FIG. 29 is a perspective view showing a method of attaching a zipper element to a bag provided with a mated and bonded edge like portion according to a conventional manner.

The zipper element 220 has a belt shape structure, as shown in FIG. 28, in combination of a male member 221 and a female member 225 to be engaged with the male member 221. The male member 221 is composed of a flat base plate 222 and a belt like protruded portion 223 formed on one side of the base plate 222. The other side **222*a* of the base plate 222 has a flat surface capable of being bonded to the inner surface of one flat portion of the bag body 210. The female member 225 is composed of a flat base plate 226 and a belt like member 228 having a recessed portion formed on one side of the base plate 226. The other side 226*a* of the base plate 226 has a flat surface capable of being bonded to the inner surface of the other flat portion of the bag body 210. The sizes of the protruded portion of the male member 221 and the recessed portion of the female member 225** are designed to be tightly engaged with each other when mated.

The flat bag 200 according to this embodiment of this invention is formed by way of the following steps.

Figure 23:
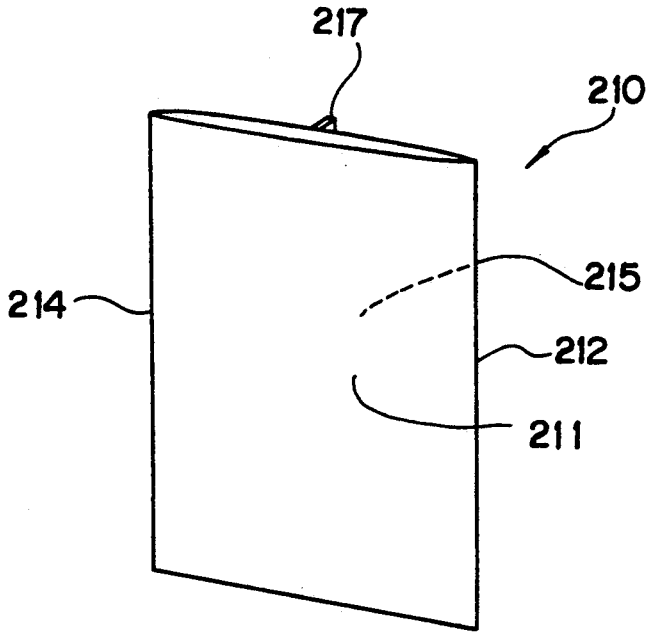
FIGS. 23 to 26 are perspective views of a flat bag provided with a zipper element of a fourth embodiment of this invention in accordance with the forming steps thereof.

First, with reference to FIG. 23, there is prepared a cylindrical or tubular bag body 210 provided with a pair of flat portions 211 and 215 constituting front and back side portions of the bag body 210, which are mated and bonded together as protruded edge like sealed portion 217. This preparation of the bag body 210 is performed by a conventional method.

Figure 24:
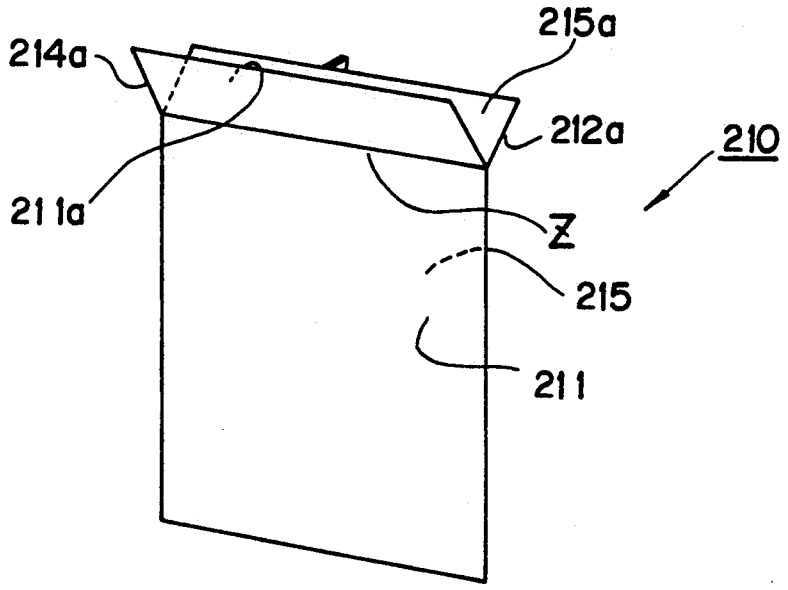
Figure 25:
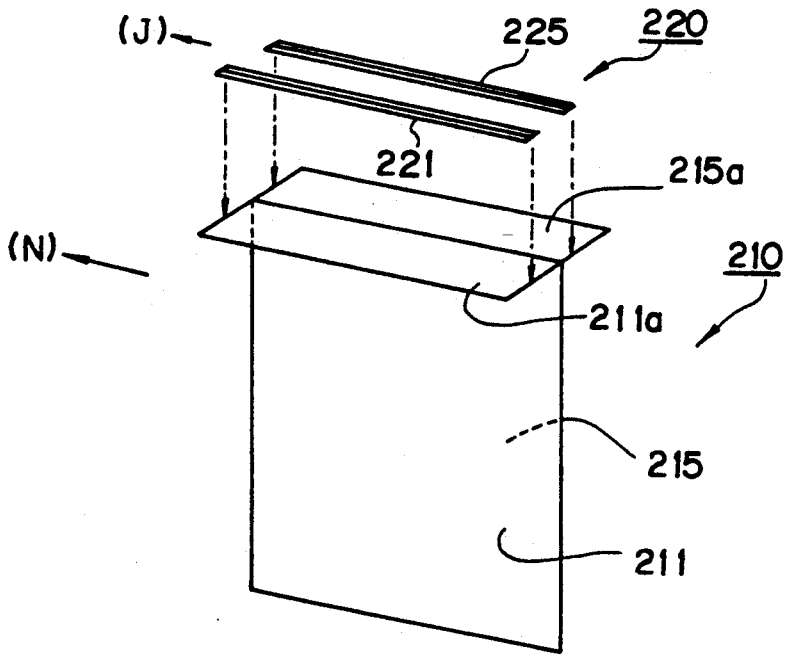

Next, as shown in FIG. 24, two cuts **212*a* and 214*a* are made from both the ends of the upper opening of the bag body 210 along the folded lines 212 and 214 so as to have cut depths each having a predetermined length from the upper end. The line connecting the bottom or end portions of these cut depths is mentioned as a base line Z to form an exposed surface portions 211*a* and 215*a*, and as shown in FIG. 25, the flat portions 211 and 215 are folded or bent outward along the base line Z so as to expose the inner surfaces 211*a* and 215*a* of the flat portions 211 and 215. During this step, the bag body 210 is delivered along a direction N, which accords with the delivering direction J of the zipper element 220 above the exposed surfaces 211*a* and 215*a***, and thus the bag body is easily worked and the steps are suitable for machine working.

Figure 26:
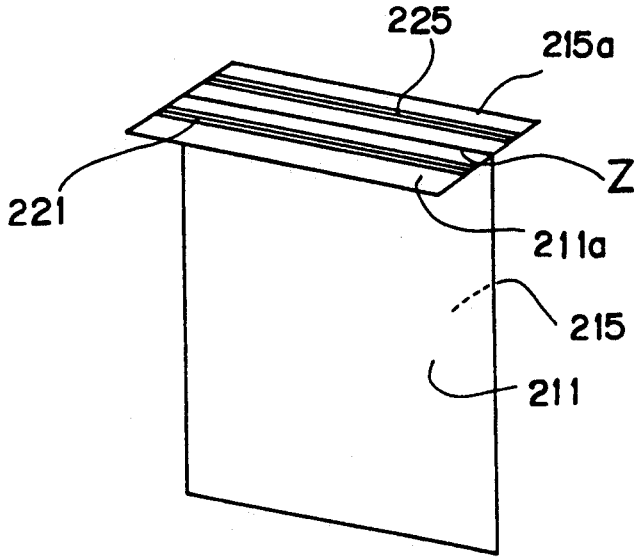

Further, in the next step, as shown in FIG. 26, the male member 221 and the female member 225 forming the zipper element 230 are fixed to the exposed opened surfaces **211*a* and 215*a*, respectively, at portions apart from the base line Z, by equal distances usually in parallel with each other. The fixing of the male and female members 221 and 225** is usually effected by a conventional heat seal method.

Then, as shown in FIG. 27, the opened surfaces **211*a* and 215*a* are closed so that the male and female members 221 and 225 are mated and engaged with each other so as to function as the zipper element 220. Thereafter, the upper end portion forming the opening end of the bag body 210 and the cut portions, near the upper ends of the folded lines 212, 214, are fused and sealed so as to form the tightly closed fused seal portions 235, 231 and 233 (the sealing surface being shown with hatching lines in FIG. 27), thus completing the flat bag 200 provided with the zipper element 220**.

A content to be contained in the flat bag thus formed is usually packed from the bottom side now being opened, and the bottom side is thereafter fused and sealed. On the contrary, it may be possible to provide the bag body having the bottom side initially sealed as disclosed with reference to the former embodiments.

According to this embodiment, the bag body is preliminarily formed by an ordinary manner. Thus, the side end portions of the upper opening portion of the bag body are cut by predetermined lengths along the folded lines to thereby bent outwardly to partially expose the inner surfaces of the flat portions of the upper portion of the bag body along the base line connecting the bottoms (or ends) of the two cuts. The male and female members constituting the zipper element are attached to the exposed surfaces, respectively. According to this structure, the zipper element can be easily and surely attached to the bag body.

It is to be understood that this invention is not limited to the embodiments described above and many other changes or modifications may be made without departing from the scope of the appended claims.

What is claimed is:

1. A gusset bag having one end to be formed as a bottom and another end to be formed as an end opening through which a content packed in the gusset bag is taken out, the gusset bag comprising:

a bag body having a tubular structure and composed of a pair of opposing flat portions constituting front and back portions of the bag body and two side portions respectively having two side ends to connect the front and back portions and respectively having folding lines which extend along longitudinal directions of the side portions and along which the side portions are folded inwardly;

a zipper element mounted on inner surfaces of the flat portions at portions near the end opening of the bag body; and a fused seal portion formed near the end opening of the bag body to substantially entirely seal the end opening, said fused seal portion including an end seal portion extending substantially along an entire length of the end opening and having two ends, and side seal portions extending from both ends of the end seal portion along the side ends of the flat portions of the bag body, said side seal portions each extending beyond the portions of the flat portions on which the zipper element is mounted, wherein a sealing process is carried out integrally with portions of the side portions near the end opening of the bag body, which are once inwardly folded along the folding lines and then drawn out and folded outwardly from the end opening of the bag body for once opening the end opening.

2. A gusset bag according to claim 1, wherein said zipper element extends throughout a whole horizontal length of the bag body and said zipper element comprises a male member attached to inner surfaces of one of the flat portions of the bag body and the side portions thereof and a female member to be engaged with the male member and attached to exposed inner surfaces of another one of the flat portions of the bag body and the side portions, said male and female member being attached at portions apart by equal distances from the end opening of the bag body.

3. A gusset bag having one end to be formed as a bottom and another end to be formed as an end opening through which a content packed in the gusset bag is taken out, the gusset bag comprising:

a bag body having a tubular structure and composed of a pair of opposing flat portions constituting front and back portions of the bag body and two side portions respectively having two side ends to connect the front and back portions and respectively having folding lines which extend along longitudinal directions of the side portions and along which the side portions are folded inwardly;

a zipper element mounted on inner surfaces of the flat portions at portions near the end opening of the bag body; and a fused seal portion formed near the end opening of the bag body to substantially entirely seal the end opening, said fused seal portion including an end seal portion extending substantially along an entire length of the end opening and having two ends, and side seal portions extending from both ends of the end seal portion along the side ends of the flat portions of the bag body, said fused seal portion being formed by sealing portions formed by once cutting and opening the bag body from two corner portions of the end opening along lines connecting either one of the front and back portions of the flat portions to the side portions of the bag body and wherein said zipper element is mounted on the inner surfaces of the flat portions of the bag body once opened at portions near the end opening other than a line connecting ends of the cuts.

4. A gusset bag according to claim 3, wherein said zipper element extends throughout a whole horizontal length of the bag body and said zipper element comprises a first zipper member attached to exposed inner surfaces of one of the flat portions of the bag body and a second zipper member to be engaged with the first zipper member and attached to exposed inner surfaces of another one of the flat portions of the bag body and the side portions, said first and second zipper member being attached at portions apart by equal distances from the end opening of the bag body.

* * * * *